United States Patent [19]

Zioni et al.

[11] 4,031,435

[45] June 21, 1977

[54] SWITCHING DEVICE

[75] Inventors: Dov Zioni; Levi Y. Halperin, both of Jerusalem, Israel

[73] Assignee: Shaare Zedek Hospital, Jerusalem, Israel

[22] Filed: Apr. 8, 1976

[21] Appl. No.: 674,863

[52] U.S. Cl. ..... 361/186; 323/34; 361/159; 361/205

[51] Int. Cl.² ..... H01H 47/32

[58] Field of Search ..... 317/148.5 B, DIG. 1, 317/DIG. 6; 323/34, 35, 37

[56] References Cited

UNITED STATES PATENTS

| | | | |
|---|---|---|---|
| 2,837,711 | 6/1958 | Lewis | 323/37 X |
| 3,763,381 | 10/1973 | Cromwell et al. | 323/34 |
| 3,947,751 | 3/1976 | Bray | 323/34 X |

FOREIGN PATENTS OR APPLICATIONS

| | | | |
|---|---|---|---|
| 660,490 | 11/1951 | United Kingdom | 323/37 |

*Primary Examiner*—R. N. Envall, Jr.
*Attorney, Agent, or Firm*—Anthony J. Casella

[57] ABSTRACT

A switching device for the indirect activation and/or termination of systems operatively coupled to the switching device which includes an inductor adapted to be periodically pulse energized, an armature movably mounted with respect to said inductor so as to assume a first and a second position relative to the inductor thereby causing a distinct variation of current flow in the inductor when energized by a periodically applied pulse, a manipulative armature positioning means and an associated electrical circuit responsive to current flowing in said inductor. The members are arranged such that the circuit is adapted to selectively indirectly actuate an external system only when said armature assumes one of said positions and a periodic energizing pulse has reached the inductor.

9 Claims, 6 Drawing Figures

SWITCHING DEVICE

FIELD OF THE INVENTION

The present invention relates to a switching device and more particularly to an indirectly activated electrical switching device for the indirect activation and/or termination of systems operatively coupled to the switching device and is related to our copending applicating Ser. No. 487,770 filed on July 11, 1974 now Pat. No. 3,980,980.

The unique switching device of the present invention is especially designed to facilitate manual activation of electrical systems on the Jewish Sabbath and Festivals when, according to the Jewish Religious Law, direct activation of such systems is generally prohibited. There are several basic limitations which such switching devices must meet in order to make them acceptable and utilizable, in certain required situations, where direct activation of systems is prohibited.

In generaly it can be said that such devices should provide indirect switching actions after being actuated by an operator, which actuation may be considered as causative and thus under the principles of the Jewish Religious Laws, fall within the categories of activity which are permitted in certain situations, to be performed on the Sabbath and Festivals.

More specifically, the switching devices according to the invention should possess the following inherent features:

1. They should electrically and/or electromagnetically isolate the initial activating means, e.g., a pushbutton, from a direct contact with or from having direct influence on any current carrying element of the device.

2. The final activation and/or termination of a system, e.g., the closing of an electrical circuit or the starting of a machine, should not be a direct result of an initial activation such as the pressing of a pushbutton.

3. The initial activation means should be a momentarily operated mechanical means such as a pushbutton or a toggle switch, whereas the final activation is precontrolled in terms of starting time and duration; and optionally.

4. The switching device should for some systems provide an automatic reset into its initial ON or OFF state for preparing the switch to perform a renewed activation operation.

There are numerous applications for such switching devices. To mention but a few examples of the applications being considered for providing solutions to specific operational problems prevalent on the Jewish Sabbath and Festivals in hospitals or other institutions, are the following: activation and interruption of an essential electrical power source; activation of emergency elevators; nurse call systems in said hospitals, old age homes or the like institutions; and activation of electrically operated medical instruments.

BRIEF DESCRIPTION OF THE INVENTION

The indirectly activated electrical switching device according to the present invention comprises an inductor adapted to be periodically pulse-energized, an armature movably mounted with respect to said inductor so as to assume a first and a second position relative to said inductor thereby causing a distinct variation of current flow in said inductor when energized by said periodically applied pulse, a manipulative armature positioning means and an associated electrical circuit responsive to current flowing in said inductor and adapted to selectively actuate an external system only when said armature assumes one of said positions and a periodic energizing pulse has reached the inductor.

The inductor of the switching device is continuously periodically energized by an A.C. or D.C. single pulse or train of pulses of any suitable frequency applied thereto. The exact time interval between two consecutive pulses or train of pulses will depend on the specific external system which the switching device is adapted to actuate and will typically range from about 5 to 20 seconds for systems which might be needed to be utilized at any unpredetermined moment.

In a preferred embodiment, it is desired that the armature be automatically reset subsequent to its being manually manipulated into one of said positions, after the switching device has performed its function, or during its performance, so as to prepare it for a repeated operation. There are, however, cases where on the contrary, it is desired that the switching state will remain in its actuated condition until the operator himself, manually, returns the manipulative armature positioning means to its original position in order to indirectly cause the external system to end its operation. For example, in a nurse call system, the indirectly activated switching device could automatically be reset after the actuation of the call signal and said signal will automatically be turned OFF at the central monitoring location by means of a timing device or the like. In contradistinction to such a system, when an electrical medical instrument is to be used for facilitating the performance of a specified treatment, the operator must have at all times complete control of the instrument and thus should be able to indirectly turn it ON and OFF as required.

The switching device according to the invention will now be more fully described with reference to the accompanying drawings, but it should be understood that these are given by way of illustration and not of limitation and that many changes in the details may be made without departing from the spirit of the invention.

DETAILED DESCRIPTION OF THE INVENTION

Figure 1:
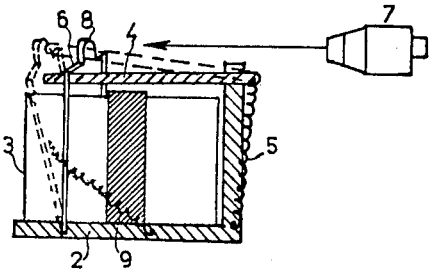
FIG. 1 is a cross-sectional side view of an automatic reset switching device constructed according to one embodiment of the invention.

In FIG. 1 there is shown a core or a coil body 2 carrying an energizing winding 3. On the body 2 there is pivotally mounted an armature 4 held against the action of a spring 5, attached thereto in a position close to the winding 3, by means of a manipulative displaceable armature-positioning-member 6.

As shown by the broken lines, when the member 6 is manually displaced, either directly or by means of pushbutton arrangement 7, said member will slip off the free edge of the armature 4 and consequently the armature, urged by spring 5, will assume a second displaced position further away from the winding 3. As long as the armature 4 stays in this position, the upper retaining portion 8 of member 6 will bear against the armatures free edge under the action of the spring 9 biasing member 6 to its initial position and thus the member 6 will also be retained in the shown displaced position. When the armature 4 is forced to return to its initial close-to-the-winding position, either electromagnetically when the winding 3 is pulse energized or otherwise mechanically when pressed downwardly, the spring urged member 6 will again slip on the armature and hold the same in its undisplaced position.

Figure 2:
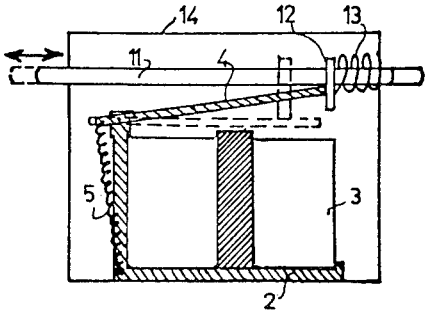
FIG. 2 is a cross-sectional side view of another embodiment of an automatic reset switching device.

The switching device with an automatic resetting arrangement according to FIG. 2, is essentially similar to that of FIG. 1, with the difference that the manipulative displaceable armature positioning member is of a different kind. It consists of a rod 11 having an armature contacting head 12 fixedly secured thereon, and a spring 13 wound around the rod 11 between the head 12 and a casing 14. As can be clearly seen in the drawing by the broken lines in its first position, the armature 4 is held close to the winding 3 against the action of spring 5 by means of the head 12 pressing thereon. When the rod 11 is axially displaced against the force of spring 13, the head 12 slips off the edge of the armature and the latter is raised to a second position, further away from the winding 3. The rod 11 will be retained in this position by means of the free edge of the armature 4, now positioned in the return path of the head 12, until the armature will be moved back to its initial position.

Figure 3:
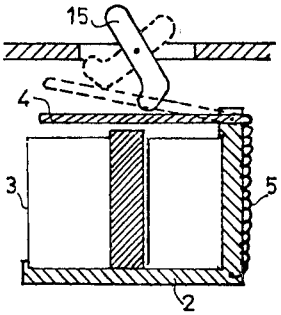
FIG. 3 is a cross-sectional side view of a manually reset switching device.

The manually reset switching device shown in FIG. 3 includes a winding and armature arrangement similar to that of FIGS. 1 and 2 but for the purposes as hereinbefore described, there is provided a manually manipulative armature-positioning-member 15 which, in the example shown, is a two position rocker or toggle switch. A dual press pushbutton actuating mechanism can also be used.

Figure 6:
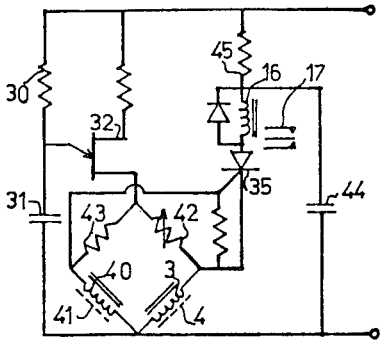
FIGS. 4—6 are diagrams of circuits used in the switches of FIGS. 1—3.
Figure 4:
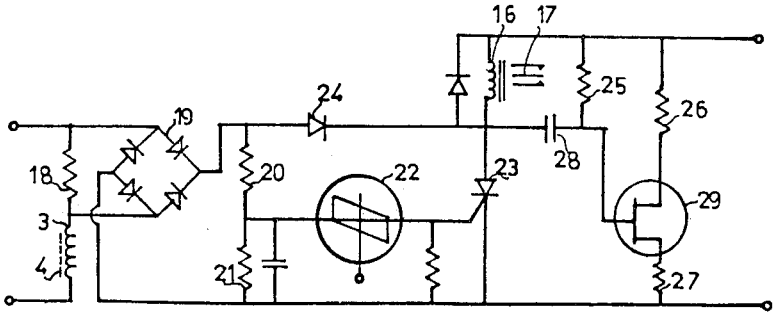
Figure 5:
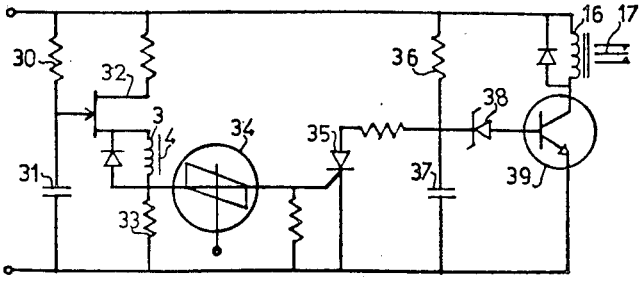

FIGS. 4 to 6 show electronic circuits for the switches of FIGS. 1 to 3. Basically, it is to be understood that when the armature is in a first position, close to the winding and the winding is pulse energized, less current will flow in said winding than when the armature is in its second position further away from the winding. This detectable difference in current between the two positions of the armature can thus be utilized for the indirect activation of an external system. The pulse or train of pulses utilizable for the activation of an external system, when the armature is in its displaced position, can also be used for automatically resetting said armature to its initial position, close to the winding, e.g. when the devices of FIGS. 1 and 2 are used. This is achieved by the electromagnetic tractive force applied on the armature by the energized winding. When, however, the device of FIG. 3 is used for a non-automatic manually reset indirect switching arrangement, the armature may be positioned at a greater distance from the winding so that the magnetic field created by the energization of the winding will not affect the armature. Naturally, the tractive force formed by the energized winding can also be counteracted by providing the armature with a strong biasing spring 5.

Turning to FIG. 4, there is shown the winding 3 and the displacable armature 4 in circuit with a relay 16 adapted to move switching contact 17 of an external system (not shown) from its normally ON or OFF position to its other position. The winding 3 is periodically pulse energized via resistor 18 and a pulsating DC voltage, formed by the bridge rectifier 19, is applied by the voltage divider 20, 21, to a voltage level detector 22, which in the shown case, is a silicon bilateral switch (SBS) or gate. If the armature 4 is in its position close to the winding, the voltage applied to detector 22 will not be sufficient to switch it to the ON state. When, however, the armature is moved to its second position further away from the winding 3, the voltage applied to detector 22 will be sufficient to turn it ON to its conducting state and conseqently to fire SCR 23 which in turn actuates the relay 16. Upon the firing of the SCR, resistor 18 will be short circuited via branches of the bridge 19 and diode 24 and the applied pulse which is still present, will cause a large current to pass in winding 3, thereby generating a field adapted to attract the armature 4 to its initial reset position.

In order to turn OFF the fired SCR 23 and subsequently to deactivate the relay 16 thereby switching back the contact 17 of an external system, there is provided a circuit arrangement consisting of resistors 25, 26 and 27 capacitor 28 and a unijunction transistor (UJT) 29. As can be understood, as SCR 23 fires, capacitor 28 charges causing UJT 29 to conduct, thus affecting the potential across the SCR 23 and turning it OFF.

The circuit shown in FIG. 5 may advantageously be used with the manually reset switching device of FIG. 3. Accordingly, the arrangement may be such that when the armature 4 is positioned close to the winding 3, there will be caused an activation of an external system and conversely, the positioning of the armature in a displaced state further away from the winding, will cause the turning OFF of the activated system.

Assuming the armature 4 is in its displaced position, when energizing pulses are applied every period, T, to the winding 3, the RC timing circuit 30, 31 will fire UJT 32 at every said period T and as the armature is in its displaced position, relatively higher voltage is applied across resistor 33. Voltage level detector SBC 34 will conduct and cause the firing of SCR 35. The RC circuit 36, 37 is designed to be charged into a level sufficient to fire zener diode 38 every period of $T_1$ which period is longer than the firing period T of the UJT 32. Thus as the SCR 35 fires, capacitor 37 discharges and zener diode 38 does not conduct to cause transistor 39 to activate the relay 16. When however, the armature 4 is positioned close to the winding 3, the potential developed across resistor 33 will not be high enough to fire SBS 34 and hence SCR 35 will remain in its non-conducting state. Consequently, capacitor 37 will not periodically discharged thereby allowing a potential, sufficient to fire zener diode 38 to be built up. Eventually there will be built up a sufficient potential to fire the diode causing the conduction of transistor 39 and the activation of relay 16. The resetting of the armature positioning member 15 of the device of FIG. 3 will, of course, deactivate the relay 16.

The circuit shown in FIG. 6 can now be readily understood. Instead of the voltage level detectors 22, 34 used in FIGS. 4 and 5 respectively, the winding 3 and the displacable armature 4 are wired in a bridge circuit comprising for simplicity, a similar winding 40 and a fixed armature 41 as well as two identical resistors 42, 43, one resistor in each of the remaining two branches. The bridge may be balanced when the armatures 4 and 41 are identically positioned with respect to the windings. Thus as the displacable armature 4 is moved, the bridge will become unbalanced and the output signal is used for the firing of the SCR 35 and in turn, the activation of relay 16.

The circuit arrangement including capacitor 44 and resistor 45 is responsible for the automatic turning OFF of the fired SCR 35 and for the automatic resetting of the displaced armature 4 as described hereinbefore with connection to FIG. 4.

While particular embodiments of this invention are shown in the figures, it will be understood that the invention is obviously subject to the variations and modifications disclosed above without departing from its broader aspects and, therefore, it is not intended that the invention be limited to the specific modifications which have been given above for the sake of illustration, but only by the appended claims.

What is claimed is:

1. An indirectly activated electrical switching device comprising an inductor adapted to be periodically pulse-energized, an armature movable mounted with respect to said inductor so as to assume a first and a second position relative to said inductor thereby causing a distinct variation of current flow in said inductor when energized by said periodically applied pulse, a manipulative armature positioning means and an associated electrical circuit responsive to current flowing in said inductor and adapted to selectively actuate and external system only when said armature assumes one of said positions and a periodic energizing pulse has reached the inductor.

2. The switching device as claimed in claim 1 further comprising a spring engaging said armature and biasing it toward, one of said positions.

3. The switching device as claimed in claim 1 wherein said inductor comprises a core.

4. The switching device as claimed in claim 1 wherein said manipulative armature positioning means is spring biased to retain said armature in one of said positions.

5. The switching device as claimed in claim 1 wherein said armature is adapted to be reset to its initial position by the magnetic field produced by said inductor when pulse-energized.

6. The switching device as claimed in claim 2 wherein said manipulative armature positioning means is a spring biased pushbutton like member adapted to retain the armature in said one position, against the action of said armature spring and to remain in this position until the armature is reset to its initial position.

7. The switching device as claimed in claim 1 wherein said associated electrical circuit comprises a timing circuit, a voltage level detector adapted to fire an SCR whenever the voltage exceeds a predetermined level and a relay activatable by said SCR for actuating an external system.

8. The switching device as claimed in claim 7 further comprising a commutating circuit for automatically turning said SCR OFF and thereby deenergizing said actuating relay.

9. The switching device as claimed in claim 7 wherein said voltage level detector is a bridge circuit in which said inductor constitutes one of its branches and said bridge circuit is balanced when said armature is retained in one of said positions, whereby when the armature is displaced to the second of said positions there is produced an output signal adapted to activate said relay and in turn to actuate an external system.

* * * * *